US005111761A

United States Patent [19]

Gilbertson

[11] Patent Number: 5,111,761

[45] Date of Patent: May 12, 1992

[54] STEERING SYSTEM FOR BOATS

[76] Inventor: Gary G. Gilbertson, 195 N. Main St., Fond du Lac, Wis. 54935

[21] Appl. No.: 591,405

[22] Filed: Oct. 1, 1990

[51] Int. Cl.[5] ..... B63H 25/10

[52] U.S. Cl. ..... 114/160; 114/144 R; 440/62

[58] Field of Search ..... 114/144 R, 154–161; 440/53, 58, 62; 74/479, 480 B, 501 R, 505, 506, 511 R, 552

[56] References Cited

U.S. PATENT DOCUMENTS

| | | | |
|---|---|---|---|
| 3,080,953 | 1/1960 | Edgemond, Jr. | 114/144 R |
| 3,131,909 | 5/1964 | Peterson | 114/160 X |
| 3,143,994 | 1/1965 | Morse | 114/144 R |
| 3,259,094 | 7/1966 | Schuler | 114/144 R |
| 3,543,314 | 12/1970 | Tropf et al. | 114/160 |
| 4,014,281 | 3/1977 | Hemens | 114/144 R |
| 4,040,375 | 8/1977 | Atkins et al. | 114/160 |
| 4,054,102 | 10/1977 | Borst et al. | 114/144 R |
| 4,513,680 | 4/1985 | Teraura | 114/159 |
| 4,531,921 | 7/1985 | Teraura et al. | 440/53 |

*Primary Examiner*—Edwin L. Swinehart
*Attorney, Agent, or Firm*—Foley & Lardner

[57] ABSTRACT

A steering system (10) of a boat (25) has a steering column (12), a dashboard mounting structure (18), a cable housing (20), and a cable (22). Parts within the cable housing (20) transfer rotation of the steering column (12) to a push-pull movement of the cable (22), causing a rudder or the like (62) to be pivoted to steer the boat (25). The cable housing (20) has a cable access door (70) to enable convenient replacement of the cable (22) as needed. The dashboard mounting structure (18) includes first and second nuts (90, 92) and a lockwasher (94) to attach the steering system (10) to the dashboard (98). The lockwasher (94) has vertical walls (106) that prevent rotation of the first nut (90) and a tab (108) that fits into a hole (104) in the dashboard (98) when the second nut (92) is tightened to prevent rotation of the lockwasher and the steering system.

19 Claims, 4 Drawing Sheets

STEERING SYSTEM FOR BOATS

FIELD OF THE INVENTION

This invention relates generally to steering systems of the type used on boats and dashboard mounting structures for such steering systems.

BACKGROUND OF THE INVENTION

Rotary steering systems used in boats typically have a steering column that extends between a steering wheel and a cable housing. Within the cable housing, rotation of the steering column is translated to a push-pull movement of a cable that extends from that housing. The cable extends out of the housing and is routed to a rudder, outboard motor, or inboard-outboard stern drive. The push-pull movement of the cable acts to pivot the rudder, outboard motor, or stern drive in a desired direction to steer the boat.

Rotary steering systems typically have a completely enclosed cable housing which cannot be readily opened to service the cable or other parts within the housing. When a cable breaks or is worn to the point that it needs to be replaced, it is not possible to access the end of the cable that enters the housing. When the parts within the housing require maintenance, it is typically not possible to open the housing to perform such maintenance. A need has therefore existed for a cable housing that is readily serviceable.

The mounting of the steering system to the dashboard of the boat is often a time-consuming process in the manufacture of a boat. Such mounting process typically requires fastening procedures on both sides of the dashboard that are time-consuming. Accordingly, a need has existed for a dashboard mount for a steering system that allows the steering mechanism to be easily and quickly installed.

SUMMARY OF THE INVENTION

The rotary steering system of the present invention comprises a steering column having an input end and an output end, a dashboard mount, a cable housing, and a cable. The steering column is mounted for bidirectional rotation and has a pinion gear attached to its output end. A disc having a circumferential surface is also mounted for bidirectional rotation and has teeth that mesh with the pinion gear, such meshing of the teeth transferring motion from the pinion gear to the disc. A first end of a cable has a specially shaped hook section affixed thereto, the hook being insertable into a hole in the circumferential surface of the disc to attach the first end of the cable to the disc. The cable is wrapped around the circumferential surface of the disc and extends tangentially outward from the disc. A cable housing encloses the disc, the pinion, and the first end of the cable. The cable exits the housing through a port. Upon rotation of the disc in one direction, the cable is wrapped further around the circumferential surface of the disc. Upon rotation of the disc in the opposite direction, the cable is unwrapped from the disc. Such wrapping and unwrapping of the cable causes pushing and pulling of the cable. The cable is routed within the boat to a rudder or to an outboard motor or stern drive unit such that pushing and pulling of the cable pivots the rudder to steer the boat.

The present invention incorporates a cable access door on the cable housing. The opening of the cable access door enables one to unhook the first end of the cable from the hole in the circumferential surface of the disc and replace the cable. Whereas in the prior art the entire cable housing unit and cable had to be replaced, the present invention allows for replacement of just the cable when it is worn, frayed, or broken.

The present invention also utilizes a dashboard mount that includes first and second nuts, and a lockwasher. The first and second nuts mate with threads on a sleeve in which the steering column is contained, the first nut meeting with threads on the first side of the dashboard and the second nut meeting with threads on the second side of the dashboard. The lockwasher is positioned between the first side of the dashboard and the first nut. The lockwasher has two vertical walls that prevent rotation of the first nut and a tab that is drawn into a hole in the dashboard upon tightening of the second nut. Mounting of the steering system to the dashboard utilizing the mounting system of the present invention is thus quickly and easily accomplished.

Further objects, features, and advantages of the invention will be apparent from the following detailed description taken in conjunction with the accompanying drawings.

DETAILED DESCRIPTION OF THE INVENTION

Figure 1:
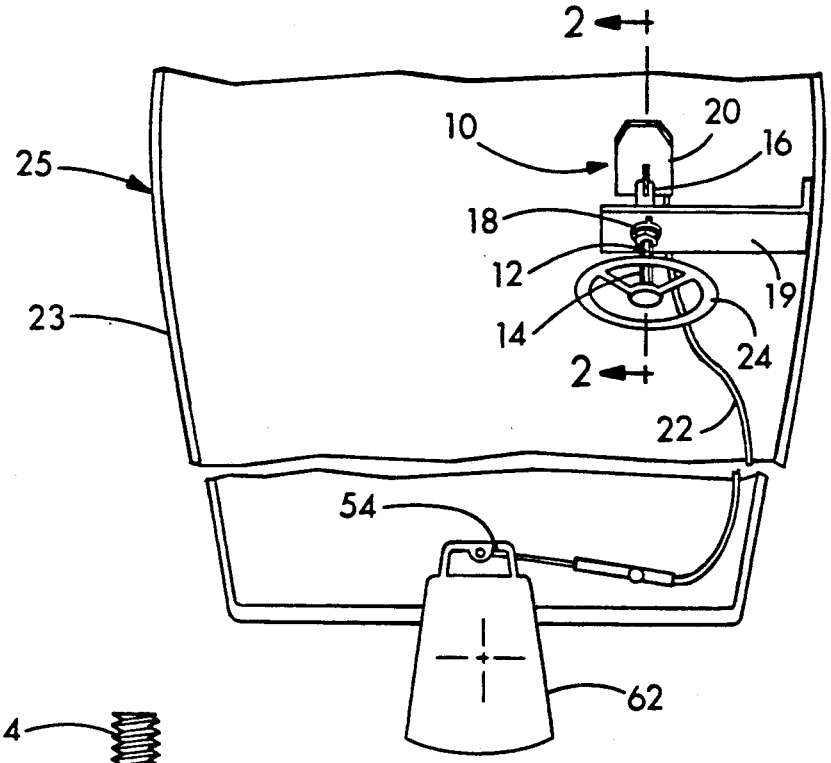
FIG. 1 is as simplified illustrative view of a boat showing the arrangement of the steering system of the present invention therein.

The steering system for boats of the present invention is shown generally at 10 in FIG. 1. The steering system 10 includes a steering column 12 having an input end 14 and an output end 16, a dashboard mounting structure 18 for mounting the steering system to a dashboard 19, a cable housing 20, and a cable 22. These parts are shown relative to a representative hull 23 of a boat 25 in FIG. 1. A steering wheel 24 is mounted to the input end 14 of the steering column 12 and the output end 16 of the steering column 12 extends into the cable housing 20.

Figure 2:
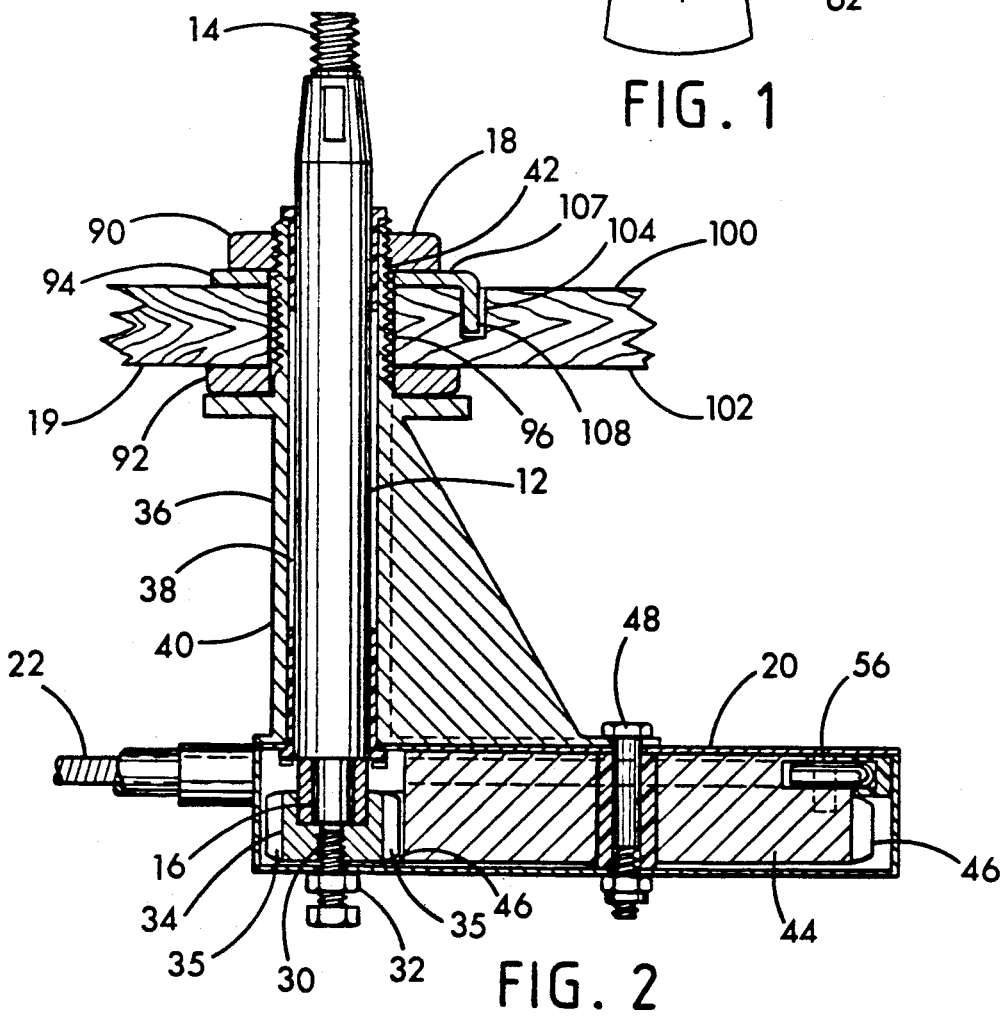
FIG. 2 is a section of the steering system taken along line 2—2 of FIG. 1.

FIG. 2 shows a partial section through the steering system 10 along line 2—2 of FIG. 1. The steering column 12 is mounted for rotation by having its output end 16 engaged with the end of a bolt 30 that is locked in place by a nut 32, the bolt 30 extending through the wall of the housing 20. The steering column 12 has a pinion 34 attached to its output end 16, the pinion 34 having gear teeth 35. The steering column 12 is mounted within a fixed sleeve 36 that extends upward from and, as shown in FIG. 2, may be an integral part of the housing 20. The sleeve 36 has an inner bore 38 in which the steering column 12 is mounted and a cylindrical outer surface 40 which has threads 42 along a portion of its length.

Enclosed within the housing 20 is a disc 44 having a circumferential surface 46 that is mounted for bidirectional rotation on a bolt 48 that extends through the rotation axis of the disc 44. The disc 44 has gear teeth 46 on its circumferential surface such that the gear teeth 35 of the pinion 34 and the gear teeth 46 of the disks mesh to transfer rotation of the steering column 12 to rotation of the disc 44.

Figure 5:
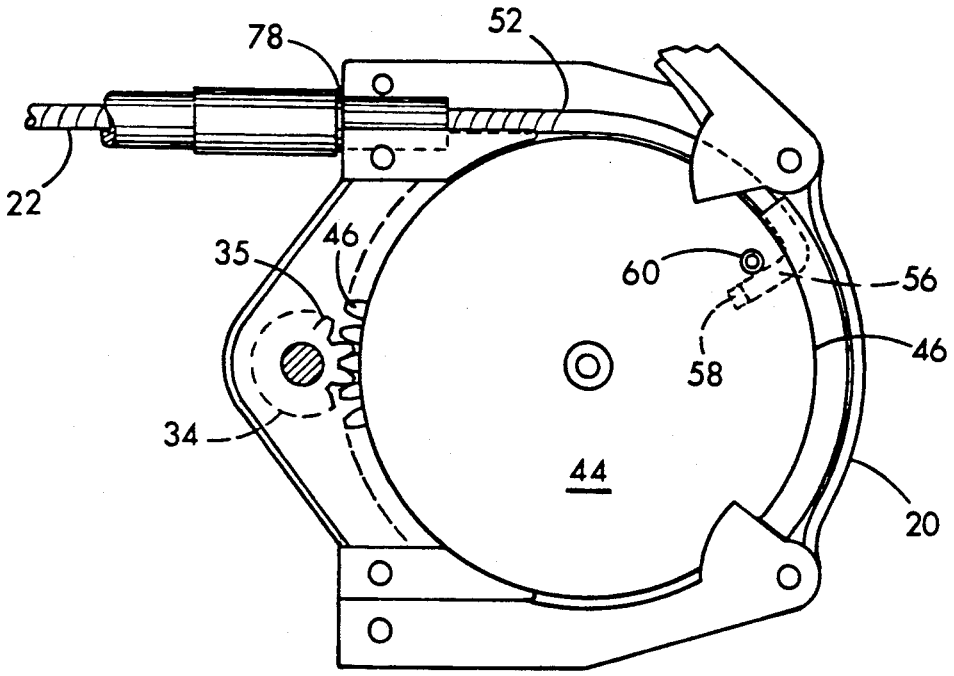
FIG. 5 is a top view of the cable housing of the rotary steering system of the present invention with the cover and sleeve removed, and one of the access doors in the open position.
Figure 6:
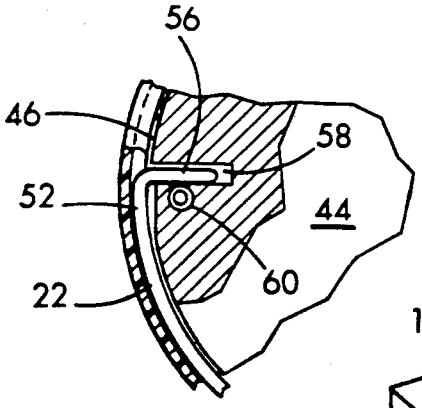
FIG. 6 is a section through the disc showing insertion of the hook of the cable therein.

The cable 22 has a first end 52 and a second end 54. The first end 52 of the flexible cable 22 has a hook section 56 attached to it and the circumferential surface of the disk has a hole 58 into which the end of the hook 56 is 5 inserted. A set screw or bolt 60 is preferably threaded through the disc 44 next to the hole 58 to provide a steering end stop. The insertion of the hook 56 into the hole is best seen in FIGS. 5 and 6. A portion of the cable 22 is wrapped around the circumferential surface 46 of the disc 44 and extends tangentially from the circumferential surface 46 such that rotation of the disc 44 in one direction causes the cable 22 to be wrapped further around the circumferential surface of the disc 44. Rotation of the disc 44 in the opposite direction causes the cable 22 to be unwrapped from the circumferential surface 46 of the disc 44. Such wrapping and unwrapping of the cable 22 about the circumferential surface 46 of the disc 44 causes the cable to be pulled and pushed, respectively. The second end 54 of the cable 22 is attached to a rudder, stern drive or outboard motor, represented schematically at 62, which pivots to turn the boat 25 in the desired direction.

Figure 3:
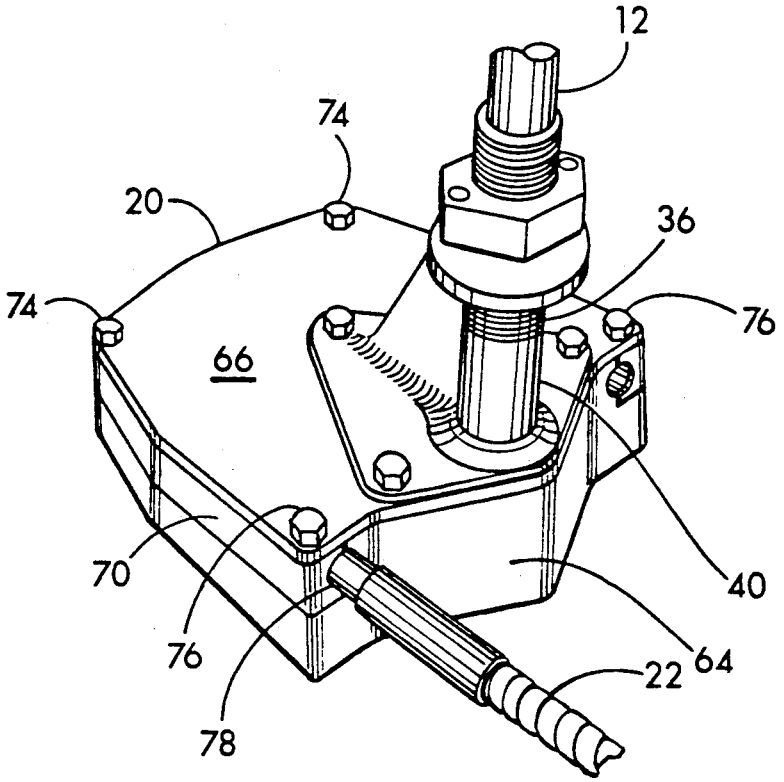
FIG. 3 is a perspective view of the cable housing of the steering system of the present invention.
Figure 4:
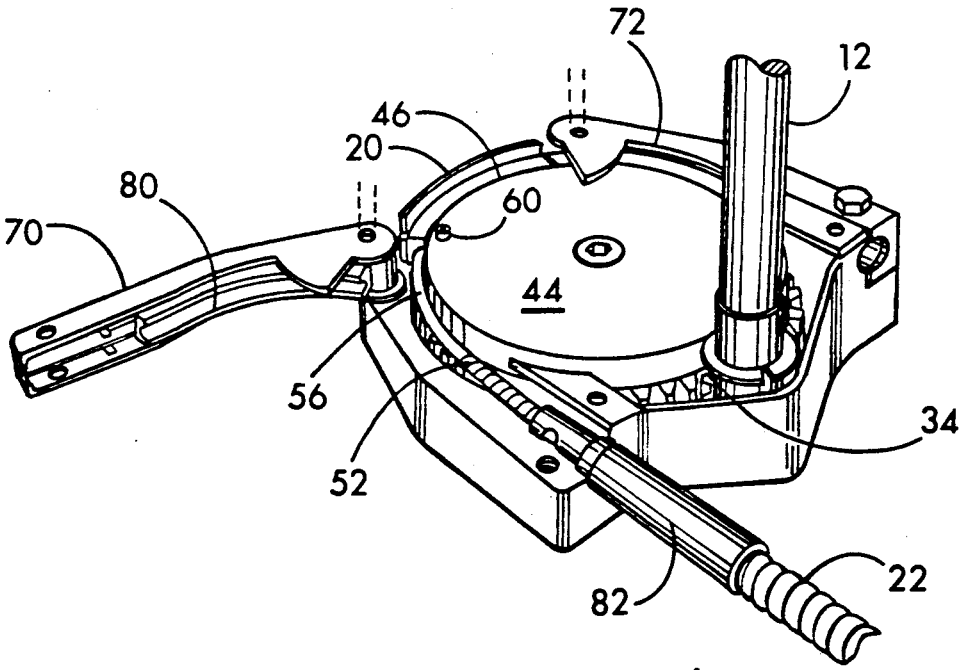
FIG. 4 is a perspective view of the cable housing of the steering system of the present invention with the cover and sleeve removed, and one of the cable access doors in the open position.

The housing 20 and arrangement of the parts within the housing 20 is best seen in FIGS. 3, 4 and 5. The housing 20 includes a main body 64, a cover 66, a first cable access door 70, and a second cable access door 72. FIG. 4 shows the housing 20 with the sleeve 36, the cover 66, and a cable access door 70 removed. The cable access doors 70 and 72 are each secured in place by screws 74 and 76. As depicted in FIG. 4, the cable access door 70 has been removed to expose the cable 22 as it is attached to the circumferential surface 46 of the disc 44. When the cable access door 70 has been removed, the cable 22 may be readily replaced when worn, frayed or broken. As viewed in FIG. 3, when the cable access door 70 is closed and secured in position by the screws 74 and 76, the cable 22 exits from the housing 20 through a port 78 formed at the mating surface of the door 70 and the main body 64 of the housing 20. The inside of the cable access door 70 has a plastic guide 80 through 5 which the cable 22 is tracked through the port 78. The cable 22 is mounted within a sleeve 82 at the port 78 to further track the cable 22 and prevent abrasion of the cable against the housing 20. The sleeve is held in place by the screw 76 that holds the cable access door 70 in place, the screw 76 fitting within an indention 84 in the sleeve 82.

The housing 22 and the parts arranged within are preferably symmetrical along an axis that runs midway between the access doors 70 and 72. The access doors 70 and 72 are therefore mirror images of each other. The cable 22 could therefore be attached to the opposite side of the housing 22 such that the first end 52 and the hook 56 of the cable 22 are accessed at the cable access door 72. The cable access door 72 may be used instead of the cable access door 70 in instances where it is advantageous to run the cable 22 from the opposite side of the housing 22 because of space or geometry concerns within the boat 25.

In certain instances, it may be desirable to have two cables attached to the disc 44, the first being accessible at the cable access door 70 and the second being accessible at the cable access door 72. For such a case, the second cable is wrapped around the circumferential surface 46 of the disc 44 in the opposite direction of the first cable. The second cable extends tangentially from the circumferential surface 46 such that rotation of the disc 44 in the direction that causes the first cable to be wrapped further around the circumferential surface 46 causes the second cable to be unwrapped from the circumferential surface of the disc 44 and causes the second cable to be pushed. Rotation of the disc 44 in the direction that causes the first cable to be unwrapped from the circumferential surface 46 causes the second cable to be wrapped further around the circumferential surface 46 and thus pulled into the housing.

Figure 7:
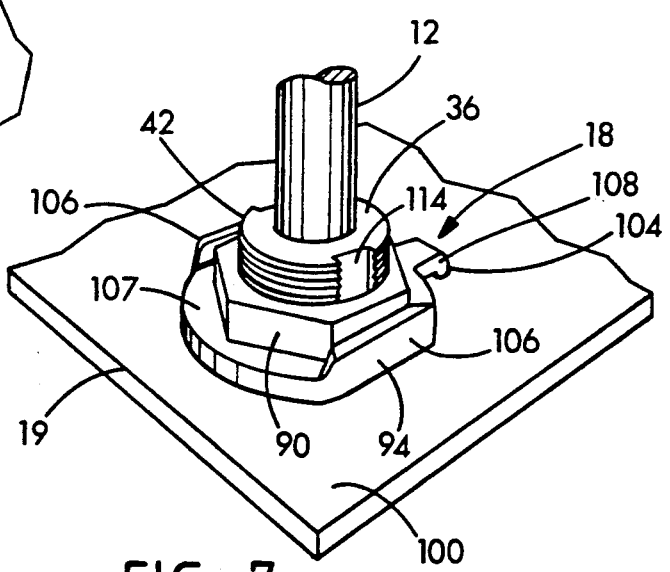
FIG. 7 is a perspective view of a portion of the dashboard mounting structure of the present invention for mounting steering systems in boats.
Figure 8:
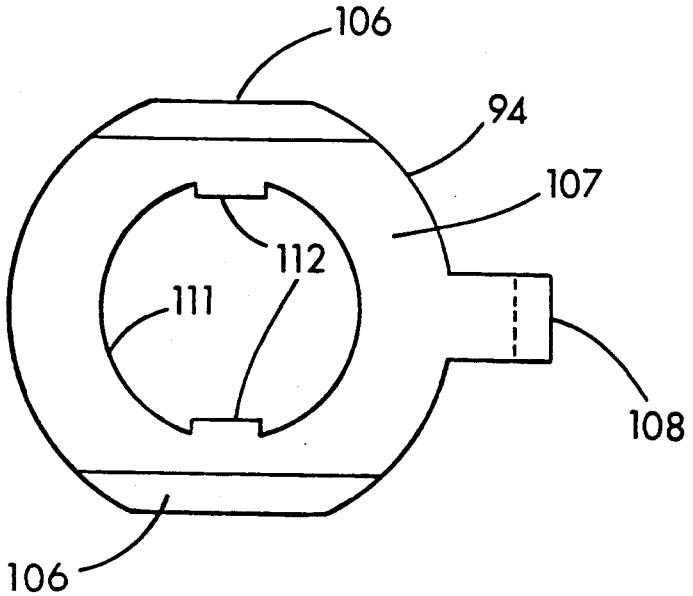
FIG. 8 is an axial view of the lockwasher portion of the steering system mounting structure.
Figure 9:
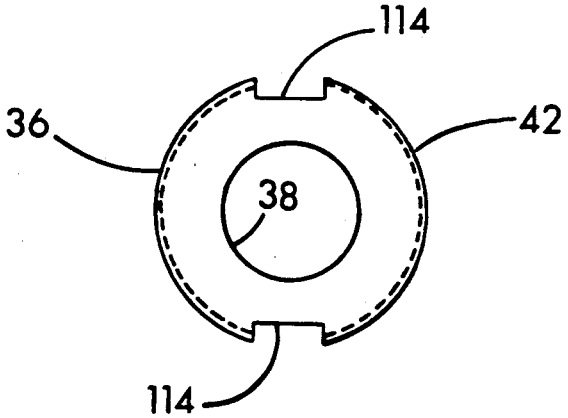
FIG. 9 is an axial view of the sleeve of the steering system within which the steering column is mounted for rotation.

FIGS. 2 and 7 best show the construction of the dashboard mounting structure 18. The dashboard mounting structure 18 comprises a first nut 90, a second nut 92, and a lockwasher 94. The first and second nuts 90 and 92 have threads that mate with the threads 42 on the cylindrical outer surface 40 of the sleeve 36. The threads 42 are located in the region of a hole 96 that penetrates the dashboard 19 from a first side 100 to a second side 102. The dashboard 19 also has a second hole 104 that penetrates the first side 100. The first nut 90 mates with the threads 42 of the sleeve 36 from the first side 100 of the dashboard and; the second nut 92 mates with the threads 42 of the sleeve 36 from the second side 102 of the dashboard 19. The lockwasher 94 is positioned between the first side 100 of the dashboard !9 and the first nut 90. The lockwasher 94 has two vertical walls 106 that extend outward from a flat base 107 the lockwasher 107 in a direction away from the dashboard 19 with the walls 106 being spaced apart such that the sides of the first nut 90 fit within and such that rotation of the first nut 90 is prevented by the walls 106. The lockwasher 94 further includes a tab 108 that extends inwardly from the base 107 of the lockwasher in a direction toward the dashboard 19 and fits within the second hole 104 of the dashboard. The lockwasher 107 has an internal bore 111, as best shown in FIG. 8, with keys 112 extending inwardly from the bore. The keys 112 fit into keyways 114 on the outer surface of the sleeve 36, thereby preventing the sleeve from rotating with respect to the lockwasher. Since the tab 108 prevents the lockwasher from rotating with respect to the dashboard, the sleeve 36 and the remainder of the steering system 10 are locked in place so they will not rotate as the steering wheel 24 is turned.

Rotation of the steering wheel 24 by an operator causes rotation of the steering column 12 along its columnar axis, and the rotation of the steering column transferred to the disc 44 by meshing of the teeth 35 of the pinion 34 with the teeth 43 on the disc 44. Rotation of the disc 44 causes the cable 22 to wrap or unwrap around the circumferential surface 46 of the disc 44, causing the second end 54 of the cable 22 to be pulled or pushed. Such pushing and pulling of the cable 22 controls the position of the rudder 62 of the boat 25.

The steering system 10 of the present invention is constructed and arranged to provide for easy assembly and maintenance. The system 10 is rapidly assembled by use of the dashboard mounting structure 18. By tightening the second nut 92, the first nut 90 is drawn within the vertical walls 105 of the lockwasher 94 and the tab 107 is drawn into the second hole 104 of the dashboard to secure and the steering system 10 to the dashboard 19 and to lock it in place against rotation. Thus, mounting of the steering system to the dashboard can be easily accomplished by a single assembly using only a wrench to tighten the second nut 92.

It is to be understood that the invention is not confined to the particular construction and arrangement of parts herein illustrated and described, but embraces all such modified forms thereof as come within the scope of the following claims.

What is claimed is:

1. A steering system for a boat comprising:

(a) a steering column rotatable about a columnar axis and having an input end and an output end;

(b) a disc having a circumferential surface and rotatable about a rotation axis;

(c) means for transferring rotation of the steering column to rotation of the disc;

(d) a cable having a first end and a second end, and means for connecting the first end to the circumferential surface of the disc with a portion of the cable being wrapped around the circumferential surface of the disc and extending tangentially from the circumferential surface such that rotation of the disc in one direction causes the cable to be wrapped further around the circumferential surface and the second end to be pulled toward the disc, and rotation of the disc in the other direction causes the cable to be unwrapped from the circumferential surface of the disc and the second end to be pushed away from the disc;

(e) a housing into which the output end of the steering column extends and that encloses the disc and the means for transferring rotation, the housing having a cable access door and a port, the cable access door being capable of being opened to allow for removal and replacement of the cable, and the port providing a passage for the cable to exit from the housing, the cable access door mounted to open to expose a portion of the circumferential surface of the disc and the means for connecting the first end of the cable to the circumferential surface of the disk, wherein the housing includes a base and a cover, the disc mounted between the base and cover for rotation, the access door mounted between the base and cover to open to expose the circumferential surface of the disc.

2. The steering system of claim 1 further comprising a steering wheel attached to the input end of the steering column.

3. The steering system of claim 1 further comprising a pinion having gear teeth that is mounted to the output end of the steering column and wherein the disc has gear teeth on its circumferential surface, and wherein the gear teeth of the pinion gear mesh with the gear teeth on the circumferential surface of the disc to thereby transfer rotation of the pinion to the disc.

4. The steering system of claim 1 wherein the inside of the door has a guide through which the cable is tracked through the port.

5. The steering system of claim 1 wherein the means for connecting the first end of the cable to the circumferential surface of the disk includes a section attached to the cable which is bent to form a hook and a hole in the circumferential surface of the disc, the first end of the cable being connected to the circumferential surface of the disc by insertion of the hook into the hole.

6. The steering system of claim 1 further comprising:

(a) a sleeve that extends from the housing, the sleeve having an inner bore in which is mounted the steering column and a cylindrical outer surface that is threaded and that has a keyway therein;

(b) a dashboard having a first side, a second side, a first hole that penetrates from the first side to the second side and that is sized to allow the sleeve to pass therethrough, and a second hole that penetrates the first side;

(c) a first nut that mates with the threads of the sleeve on the first side of the dashboard;

(d) a second nut that mates with the threads of the sleeve on the second side of the dashboard;

(e) a lockwasher that is positioned between the first side of the dashboard and the first nut, the lockwasher having a base and a wall that extends from the base in a direction away from the dashboard, the wall positioned to engage and prevent rotation of the first nut, and the lockwasher further having a tab that extends outwardly from the base and then inwardly from the lockwasher in a direction toward the dashboard and fits within the second hole of the dashboard when the second nut is rotated on its threads to be drawn toward the second side of the dashboard, the base having a bore within which the sleeve fits and a key extending inwardly from the bore to engage with the keyway in the sleeve to prevent rotation of the sleeve with respect to the lockwasher.

7. The steering system of claim 1 wherein the access door is held in its closed position by a screw passed through holes in the cover and the access door and threaded into a hole in the base.

8. The steering system of claim 7 further including a sleeve through which the cable passes at the port from the housing, and wherein the screw holding the access door in its closed position engages the sleeve to hold the sleeve in place.

9. The steering system of claim 1 wherein the housing has two access doors mounted on opposite sides of the disc.

10. The steering system of claim 4 wherein the guide on the access door is formed of plastic.

11. A steering system for a boat comprising:

(a) a steering column rotatable about a columnar axis and having an input end and an output end;

(b) a disc having a circumferential surface and rotatable about a rotation axis;

(c) means for transferring rotation of the steering column to rotation of the disc;

(d) a cable of fixed length having a first end and a second end, the first end being connected to the circumferential surface of the disc with a portion of the cable being wrapped around the circumferential surface of the disc and extending tangentially from the circumferential surface such that rotation of the disc in one direction causes the cable to be wrapped further around the circumferential surface and the second end to be pulled toward the disc, and rotation of the disc in the other direction causes the cable to be unwrapped from the circumferential surface of the disc and second end to be pushed away from the disc; and (e) a housing into which the output end of the steering column extends and that encloses the disc and the means for transferring rotation, wherein the first end of the cable has a section attached thereto which is bent to form a hook and the circumferential surface of the disc has a hole, the first end of the cable being connected to the circumferential surface of the disc by insertion of the hook into the hole, and an access door mounted to open to expose a portion of the circumferential surface of the disc and the hook on the first end of the cable, whereby when the door is opened the cable can be disconnected from the disc by pulling the hook out of the hole in the circumferential surface of the disk, wherein the housing includes a base and a cover, the disc mounted between the base and cover for rotation, the access door mounted between the base and cover to open to expose the circumferential surface of the disc.

12. The steering system of claim 11 further comprising a steering wheel attached to the input end of the steering column.

13. The steering system of claim 11 further comprising a pinion having gear teeth that is mounted to the output end of the steering column and wherein the disc has gear teeth on the circumferential surface, and wherein the gear teeth of the pinion gear mesh with the gear teeth of the circumferential surface of the disc to thereby transfer rotation of the pinion to the disc.

14. The steering system of claim 11 further comprising:

(a) a sleeve that extends from the housing, the sleeve having an inner bore in which is mounted the steering column and a cylindrical outer surface that is threaded and that has a keyway therein;

(b) a dashboard having a first side, a second side, a first hole that penetrates from the first side to the second side and that is sized to allow the sleeve to pass therethrough, and a second hole that penetrates the first side;

(c) a first nut that mates with the threads of the sleeve on the first side of the dashboard;

(d) a second nut that mates with the threads of the sleeve on the second side of the dashboard;

(e) a lockwasher that is positioned between the first side of the dashboard and the first nut, a lockwasher having a base and a wall that extends from the base in a direction away from the dashboard, the wall positioned to engage and prevent rotation of the first nut, and the lockwasher further having a tab that extends outwardly from the base and then inwardly toward the dashboard and fits within the second hole of the dashboard when the second nut is rotated on its threads to be drawn toward the second side of the dashboard, the base having a bore within which the sleeve fits and a key extending inwardly from the bore to engage with the keyway in the sleeve to prevent rotation of the sleeve with respect to the lockwasher.

15. A steering system for a boat comprising:

(a) a steering column rotatable about a columnar axis and having an input end and an output end;

(b) a disc having a circumferential surface and rotatable about a rotation axis;

(c) means for transferring rotation of the steering column to rotation of the disc;

(d) a cable having a first end and a second end, the first end being connected to the circumferential surface of the disc with a portion of the cable being wrapped around the circumferential surface of the disc and extending tangentially from the circumferential surface such that rotation of the disc in one direction causes the cable to be wrapped further around the circumferential surface and the second end to be pulled toward the disc, and rotation of the disc in the other direction causes the cable to be unwrapped from the circumferential surface and the second end to be pushed away from the disc;

(e) a housing into which the output end of the steering column extends and that encloses the disc and the means for transferring rotation;

(f) a sleeve that extends from the housing, the sleeve having an inner bore in which is mounted the steering column and a cylindrical outer surface that is threaded and that has a keyway therein;

(g) a dashboard having a first side, a second side, a first hole that penetrates from the first side to the second side and that is sized to allow the sleeve to pass therethrough, and a second hole that penetrates the first side;

(h) a first nut that mates with the threads of the sleeve on the first side of the dashboard;

(i) a second nut that mates with the threads of the sleeve on the second side of the dashboard; and (j) a lockwasher that is positioned between the first side of the dashboard and the first nut, the lockwasher having a base and a wall that extends from the base in a direction away from the dashboard, the wall positioned to engage and prevent rotation of the first nut, and the lockwasher further having a tab that extends outwardly from the base and then inwardly toward the dashboard and fits within the second hole of the dashboard when the second nut is rotated on its threads to be drawn toward the second side of the dashboard, the base having a bore within which the sleeve fits a key extending inwardly from the bore to engage with the keyway in the sleeve to prevent rotation of the sleeve with respect to the lockwasher.

16. The steering system of claim 15 further comprising a steering wheel attached to the input end of the steering column.

17. The steering system of claim 15 further comprising a pinion having gear teeth that is mounted to the output end of the steering column and wherein the disc has gear teeth on its circumferential surface, and wherein the gear teeth of the pinion gear mesh with the gear teeth of the circumferential surface.

18. The steering system of claim 15 wherein the first end of the cable has a section attached thereto which is bent to form a hook and the circumferential surface of the disc has a hole, the first end of the cable being connected to the circumferential surface of the disc by insertion of the hook into the hole.

19. A mounting structure for mounting a steering system to the dashboard of a boat, wherein the steering system has a steering wheel attached to a steering column which fits within a sleeve extending through the dashboard, the sleeve having an outer cylindrical surface that is threaded and that has a keyway therein, the mounting structure comprising:

(a) a first nut that mates with the threads of the sleeve on one side of the dashboard;

(b) a second nut that mates with the threads of the sleeve on the other side of the dashboard;

(c) a lockwasher that is positionable between one side of the dashboard and the first nut, the lockwasher having a base and a wall which extends from the base and is positioned to engage and prevent rotation of the first nut, the lockwasher further having a tab that extends outwardly from the base and then inwardly so that it can fit within a hole formed in the dashboard to thereby prevent rotation of the lockwasher with respect to the dashboard, the base having a bore within which the sleeve fits and a key extending inwardly from the bore to engage with the keyway in the sleeve to thereby prevent rotation of the sleeve with respect to the lockwasher.

* * * * *